United States Patent [19]

Seal et al.

[11] Patent Number: 4,528,441

[45] Date of Patent: Jul. 9, 1985

[54] ELECTRICAL RESISTANCE HEATING ASSEMBLY

[75] Inventors: Douglas T. Seal, Strawberry Plains; Charles A. Haynes, Seymour, both of Tenn.

[73] Assignee: Carrier Corporation, Syracuse, N.Y.

[21] Appl. No.: 561,264

[22] Filed: Dec. 14, 1983

[51] Int. Cl.[3] ..... H05B 3/06

[52] U.S. Cl. ..... 219/532; D13/18; 174/175; 174/138 J; 219/536; 219/542; 338/304

[58] Field of Search ..... 219/374, 375, 532, 536, 219/537, 542, 546, 550; 174/138 J, 175, 212; 338/299, 304, 305, 320; D13/17, 18; 373/130

[56] References Cited

U.S. PATENT DOCUMENTS

| | | | |
|---|---|---|---|
| D. 251,260 | 10/1981 | Seeley | D13/18 |
| D. 262,285 | 12/1981 | Janning | D13/18 |
| 2,856,500 | 10/1958 | Hartman | 219/536 |
| 3,134,836 | 5/1964 | Malinowski | 174/175 X |
| 3,952,409 | 4/1976 | Allison et al. | 29/611 |
| 3,992,609 | 11/1976 | Alexander | 219/532 |
| 4,250,399 | 2/1981 | King | 219/532 |
| 4,268,742 | 5/1981 | Cottrell et al. | 219/532 |
| 4,363,959 | 12/1982 | Cottrell et al. | 219/532 |

FOREIGN PATENT DOCUMENTS

| | | | |
|---|---|---|---|
| 1185906 | 8/1959 | France | 174/175 |
| 1276725 | 10/1961 | France | 174/175 |
| 576759 | 4/1946 | United Kingdom | 174/175 |

*Primary Examiner*—Volodymyr Y. Mayewsky
*Attorney, Agent, or Firm*—Robert H. Kelly

[57] ABSTRACT

An electrical resistance heating assembly having specially designed electrical insulators is disclosed. The electrical insulators have arms shaped to retain an electrical resistance heating coil which can be quickly, easily, and reliably mounted on the arms of the insulator. Top parts of the arms are generally rectangular or triangular in cross section and the arms are spaced and configured relative to each other to form a generally T-shaped opening between the arms, with the ends of the cross bar of the T-shaped opening forming electrically resistance heating coil retention surfaces. Also, cuts in side surfaces of the insulators may provide additional coil retention surfaces. The insulators have either an extended base portion for directly mounting the insulators to a mounting bar of the electrical resistance heating assembly or the insulators simply comprise slabs of electrically insulating material which are each mounted on a cross bar which is attached to a mounting bar of the electrical resistance heating assembly.

6 Claims, 5 Drawing Figures

ELECTRICAL RESISTANCE HEATING ASSEMBLY

BACKGROUND OF THE INVENTION

The present invention relates to electrical resistance heating assemblies and more particularly relates to electrical insulators used in such electrical resistance heating assemblies.

Electrical resistance heating assemblies of the type having a resistance element connected to a source of electrical power and mounted on a suitable support structure which includes insulating members are used in various applications. For example, such assemblies may be used to independently provide heat for a space or a room. Alternatively, such assemblies may be incorporated into a larger piece of equipment, such as an air conditioning unit, to provide warm air when required.

Important considerations relative to such electrical resistance heating assemblies are ease and cost of manufacturing the assemblies and reliability of the assemblies. In this regard, the electrical insulators used in such assemblies should be simple, reliable, relatively easy to attach to a mounting bar, and electrical resistance heating coils of varying sizes should be easily mounted on the insulators.

SUMMARY OF THE INVENTION

Therefore, an object of the present invention is to improve the reliability of electrical resistance heating assemblies.

Another object of the present invention is to simplify attachment of electrical insulators to a mounting bar in an electrical resistance heating assembly.

A further object of the present invention is to provide an electrical resistance heating assembly having relatively simple and inexpensive insulators upon which electrical resistance heating coils of varying sizes may be easily, quickly, and reliably mounted.

These and other objects of the present invention are attained by an electrical resistance heating assembly having special electrical insulators mounted on a mounting bar. Each of the special electrical insulators includes a slab of electrically insulating material having arms extending therefrom configured to form a generally T-shaped opening between the arms. The ends of the cross bar of the T-shaped opening between the arms form electrical resistance coil retention surfaces. The arms each have a top part which may have a generally triangular cross section, or may have a generally rectangular cross section, in a plane parallel to the front and back surfaces of the slab of electrically insulating material. If the arms have a triangular cross section then one of the arms is longer than the other arm to provide an extended stop surface against which an electrical resistance heating coil may be compressed during mounting of the coil on the electrical insulator to aid in mounting the coil on the insulator.

Cuts may be provided in side surfaces of the slab of electrically insulating material generally in the same plane as the cross bar of the T-shaped opening between the first and second arms for engaging coil loops spread over side surfaces of the first and second arms. In addition, notches in the side surfaces of the slab of electrically insulating material, below the cuts in the side surfaces, may be positioned and sized to provide relief from thermal stresses caused by heat conduction away from the electrical resistance heating coil to the slab of electrically insulating material during operation of the electrical resistance heating assembly.

The special insulators according to the present invention may be mounted on one end of a cross bar attached to the mounting bar of the electrical resistance heating assembly. This mounting is easily, reliably and efficiently accomplished by providing the electrical insulator with a central opening through which a generally flat neck and head portion of the cross bar may be inserted and twisted to lock the insulator in position between the head and a shoulder portion of the cross bar. The shoulder, neck and head of the cross bar are sized relative to the central opening in the insulator so that the head and neck of the cross bar may be twisted about their central longitudinal axes without shearing any part of the cross bar. Alternatively, a special insulator according to the present invention may have a base portion integral with and extending generally vertically outward away from the slab of electrically insulating material of the electrical insulator for directly attaching the insulator to the mounting bar thereby eliminating the need for a cross bar.

BRIEF DESCRIPTION OF THE DRAWING

Other objects and advantages of the present invention will be readily apparent from the following detailed description in conjunction with the accompanying drawing, wherein like reference numerals identify like elements, and in which.

DESCRIPTION OF THE PREFERRED EMBODIMENT

Figure 1:
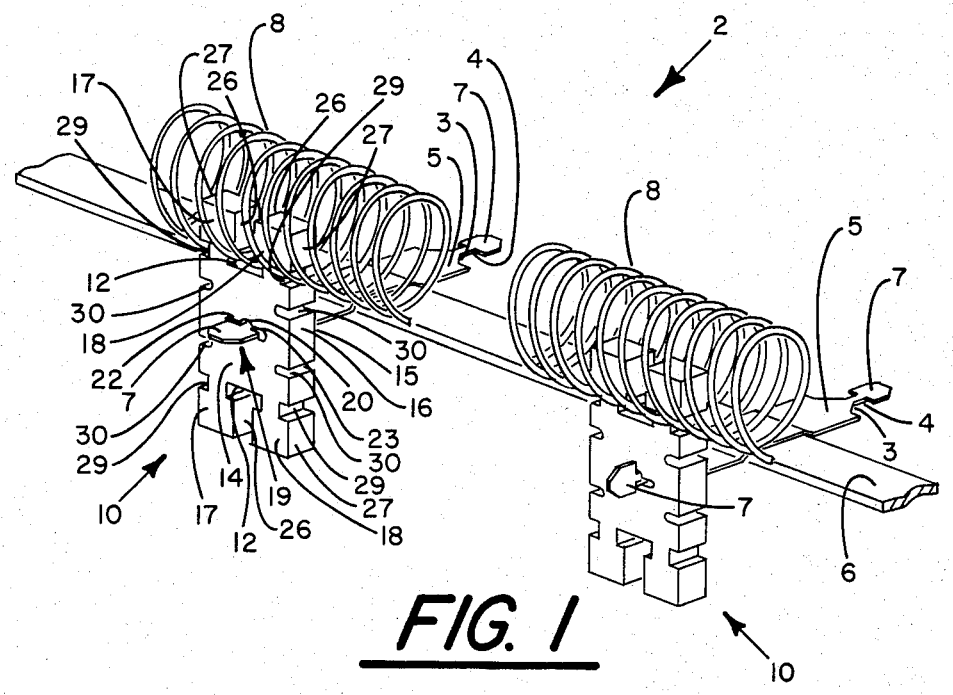
FIG. 1 is a fragmentary, perspective view of an electrical resistance heating assembly with electrical insulators according to the present invention mounted on cross bars attached to a mounting bar.

Referring to FIG. 1, a fragmentary, perspective view is shown of an electrical resistance heating assembly 2 with electrical insulators 10 according to the present invention. Each of the electrical insulators 10 is mounted on a cross bar 5 which is attached to or which is integral with a mounting bar 6 of the electrical resistance heating assembly 2. An electrical resistance heating coil 8 is mounted on the electrical insulators 10. For clarity in FIGS. 1 and 2, the electrical resistance heating coil 8 is shown mounted on only one end of each insulator 10 but it is to be understood that in practice the coil 8 may be mounted on both ends of each insulator 10.

As shown in FIG. 1, each cross bar 5 extends outward away from the mounting bar 6 in a direction generally perpendicular to the mounting bar 6. Each cross bar 5 is attached to the mounting bar 6 by crimping the cross bar 5 to the mounting bar 6. However, the cross bar 5 may be attached to the mounting bar 6 in any of a variety of ways as will be readily apparent to one of ordinary skill in the art to which the present invention pertains. For example, the cross bar 5 may be welded or riveted to the mounting bar 6.

Also, as shown in FIG. 1, at least one end of each cross bar 5 is shaped to form a tapered shoulder portion 3 with a generally flat neck portion 4 extending outward away from the shoulder portion 3. A generally flat head portion 7 extends outward away from the neck portion 4 in the same plane as the neck portion 4 to facilitate mounting of the electrical insulator 10 on the cross bar 5 as will be described in detail below.

Further, as shown in FIG. 1, each electrical insulator 10 includes a slab of electrically insulating material, which may be made of a ceramic material like steatite or cordierite, having a generally flat front surface 14 and an opposed, parallel, generally flat back surface 15 with side surfaces 16 and end surfaces 12 generally perpendicular to the front and back surfaces 14 and 15. At least one end surface 12 has two arms 17 and 18 extending therefrom. The arms 17 and 18 are spaced apart and configured relative to each other to form a generally T-shaped opening between the arms 17 and 18 with the ends of the cross bar of the T forming electrical resistance heating coil retention surfaces. The leg of the T-shaped opening is formed by opposed, facing, generally flat vertical surfaces which are generally parallel to each other.

The slab of electrically insulating material has a thickness approximately equal to the length of the neck portion 4 of the cross bar 5. Also, the slab of electrically insulating material has a generally centrally located opening 19 extending through the slab between the front 14 and back 15 surfaces of the slab. The central opening 19 has a generally circular section 20 having a diameter larger than the width of the neck portion 4 of the cross bar 5 and less than the width of the head portion 7 of the cross bar 5. Also, there are two opposed slot sections 22 and 23 extending from the circular section 20 a distance sufficient to allow the head portion 7 of the cross bar 5 to pass through the central opening 19 in the slab as shown on the left side of FIG. 1. The slab of electrically insulating material is mounted on the end of the cross bar 5 by passing the head portion 7 of the cross bar 5 through the central opening 19 in the slab of insulating material and twisting the head portion 7 and the neck portion 4 about their central longitudinal axes to lock the slab of electrically insulating material in position between the head portion 7 and the shoulder portion 3 of the cross bar 5 as shown on the right side of FIG. 1.

Preferably, the shoulder portion 3 is tapered to extend a relatively small distance into the opening 19 in the slab of electrically insulating material when the slab of electrically insulating material is locked into position on the cross bar 5. This substantially prevents side-to-side movement of the electrical insulator 10 when the electrical insulator 10 is mounted on the cross bar 5. Of course, as will be readily apparent to one of ordinary skill in the art to which the present invention pertains, the shoulder portion 3 may have other shapes, for example, the shoulder portion 3 may be simply squared off. Also, it should be noted that the end of the cross bar 5 may simply provide a mounting surface against which the insulator 10 may be mounted with a screw inserted through a central opening in the insulator 10 and screwed into the mounting surface on the end of the cross bar 5.

As shown in FIG. 1, the generally circular section 20 allows the head portion 7 and the neck portion 4 to be twisted about their central longitudinal axes without shearing any part of the cross bar 5. In this manner, the electrical insulator 10 is readily and reliably mounted on the cross bar 5 without unduly stressing the cross bar 5 thereby reducing chances of breakage and weakening of the structure of the cross bar 5.

Still further as shown in FIG. 1, the two arms 17 and 18 of the slab of electrically insulating material each have a top part with a generally rectangular cross section in a plane parallel to the front and back surfaces 14 and 15 of the slab of electrically insulating material. One face 26 of the top part is a generally flat surface which forms one of the vertical surfaces of the leg of the T-shaped opening between the arms 17 and 18. The outer, opposite, parallel side of the rectangular top part provides a surface 27 over which a coil loop of the electrical resistance heating coil 8 may be spread when the coil 8 is mounted on the slab of electrically insulating material.

Cuts 29 in the side surfaces 16 of the slab of electrically insulating material are generally in the same plane as the cross bar of the T-shaped opening between the first and second arms 17 and 18 and engage the coil loops spread over the side surfaces 27 of the first and second arms 17 and 18. These cuts 29 aid in retaining the electrical resistance heating coil 8 on the insulator 10. However, it should be noted that the cuts 29 need not be provided for the electrical insulator 10 to adequately retain the coil 8 on the insulator 10. If the cuts 29 are not provided then the coil loops simply spread out over the side surfaces 27 and the coil 8 is retained on the insulator 10 within the T-shaped opening between the arms 17 and 18.

Still further as shown in FIG. 1, the electrical insulators 10 include notches 30 in the side surfaces 16 of the slab of electrically insulating material below the cuts 29 in the side surfaces 16 of the slab of electrically insulating material. The notches 30 are positioned and sized to provide relief from thermal stresses caused by heat conduction away from the electrical resistance heating coil 8 through the slab of electrically insulating material during operation of the electrical resistance heating assembly 2. The size, position, and configuration of the notches 30 for any particular electrical insulator design are determined through a trial and error method. Basically, the notches 30 are sized and positioned to allow material in contact with and material near the coil 8 to expand and contract without generating stresses sufficient to seriously crack or break the slab of electrically insulating material as the coil 8 heats up and cools off during operation of the electrical resistance heating assembly 2. Of course, the notches 30 may not be necessary depending on factors such as the thermal characteristics of the material comprising the slab, the mass of the slab, and the structural design of the slab.

Figure 2:
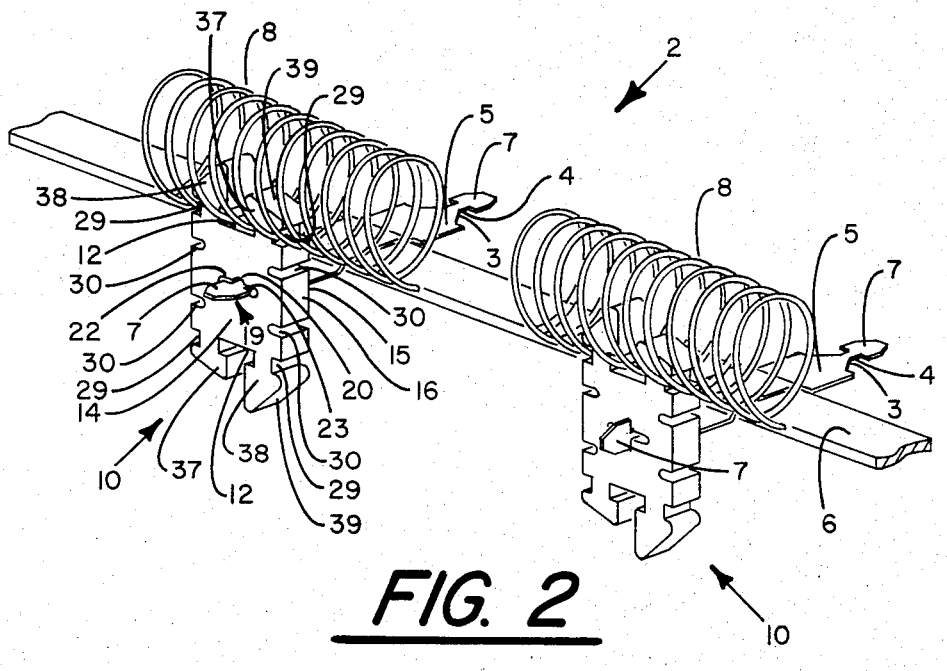
FIG. 2 is a fragmentary, perspective view of an electrical resistance heating assembly illustrating an alternative embodiment of an electrical insulator according to the present invention.
Figure 3:
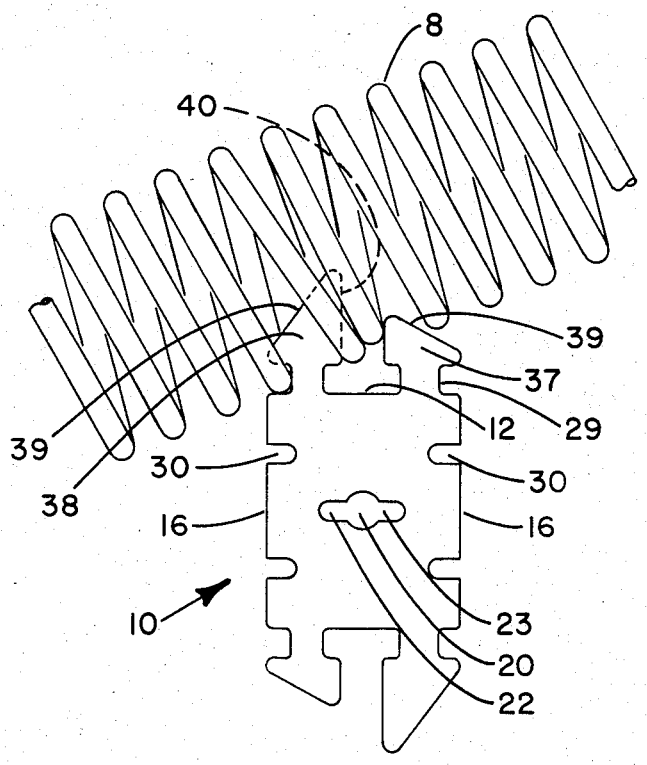
FIG. 3 shows an electrical insulator of the kind illustrated in FIG. 2 with an electrical resistance heating coil in the process of being mounted on the insulator.

Referring to FIGS. 2 and 3, another embodiment is shown of an electrical resistance heating assembly 2 with electrical insulators 10 according to the present invention. The structure of the heating assembly 2 and the insulators 10 is very similar to the structure of the heating assembly 2 and insulators 10 shown in FIG. 1 and like reference numerals have been used to identify like elements. However, the electrical insulators 10 shown in FIGS. 2 and 3 include two arms 37, 38 each having a top part with a generally triangular cross section in a plane parallel to the front 14 and back 15 surfaces of the slab of electrically insulating material. One leg of each of the triangular top parts defines one of the generally flat vertical surfaces which form part of the leg of the T-shaped opening between the arms 37, 38. The hypotenuse of each of the triangular top parts forms a cam surface 39 for spreading a coil loop of the electrical resistance heating coil 8 when the coil 8 is mounted on the slab of electrically insulating material.

As best shown in FIG. 3, one arm 38 of the electrical insulator 10 extends outward away from the end surface 12 of the insulator 10 a distance greater than the distance that the other arm 37 of the insulator 10 extends outward away from the end surface 12. This provides a stop surface 40 against which loops of the electrical resistance heating coil 8 may be compressed during mounting of the coil 8 on the electrical insulator 10. By angling the longitudinal axis of the coil 8 relative to the stop surface 40 during the mounting process, one loop of the coil 8 will slide into the T-shaped opening between the arms 37, 38 followed by a second loop of the coil 8 as depicted in FIG. 3. (FIG. 2 shows the coil 8 mounted in its final position on the insulator 10.) Therefore, even if the combined diameters of two loops of the wire forming the coil 8 is greater than the width of the leg of the T-shaped opening between the arms 37, 38, such a coil 8 may still be easily, efficiently and reliably mounted on the electrical insulator 10 because of the provision of the stop surface 40 which allows one coil loop at a time to be mounted on the arms 37, 38 of the electrical insulator 10. Of course, a coil 8 made of wire with a smaller diameter may be easily, efficiently, and reliably mounted on the arms 37,38 of the insulator 10 by compressing the coil 8 against the stop surface 40 with the longitudinal axis of the coil 8 generally perpendicular to the stop surface 40 and then sliding the compressed loops of the coil 8 into their final position between the arms 37,38.

Also, regarding the insulators 10 shown in FIG. 1, it should be noted that one of the faces 26 of the arms 17, 18 may be used as a stop surface when mounting the coil 8 on the insulator 10 with the longitudinal axis of the coil 8 at an angle relative to the face 26 which is acting as the stop surface. In this mounting process, one loop of the coil 8 slides over the side surface 27 of one of the arms 17 or 18 with the longitudinal axis of the coil 8 generally at an angle relative to the face 26 of the arm 17 or 18 which is acting as the stop surface. An adjacent loop of the coil 8 is spread over in contact with the face 26. Then, coil loops of the coil 8 are compressed against the face 26 and two loops of the coil 8 are pushed, essentially one at a time, down into the T-shaped opening between the arms 17, 18. FIG. 1 shows a coil 8 mounted in its final position on the insulator 10. Of course, the coil 8 may also be easily, efficiently, and reliably mounted on the arms 17, 18 of the insulator 10 by pushing loops of the coil 8 down into the T-shaped opening between the arms 17, 18 and over the side surfaces 27 of the arms 17, 18 with the longitudinal axis of the coil 8 generally perpendicular to the faces 26 of the arms 17, 18.

Figure 4:
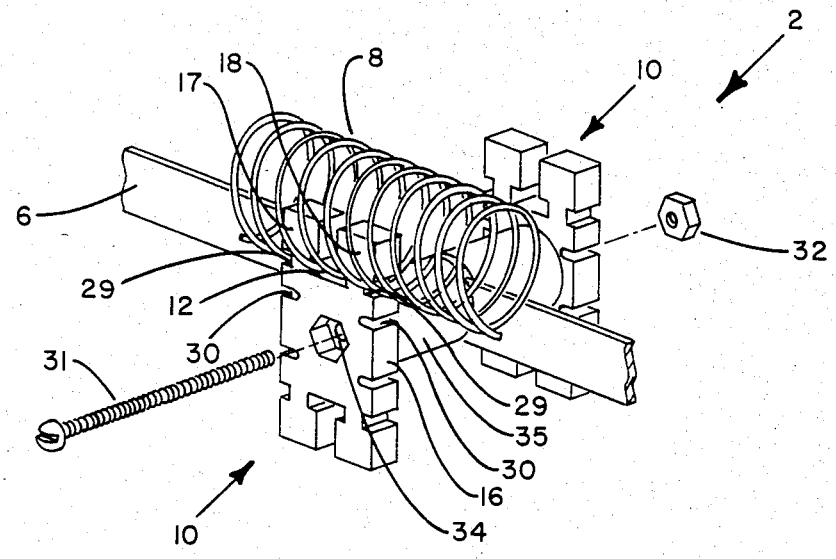
FIG. 4 is a fragmentary, partly exploded, perspective view of an electrical resistance heating assembly with back-to-back electrical insulators according to the present invention each having a base portion for directly attaching the insulators to a mounting bar of the assembly.
Figure 5:
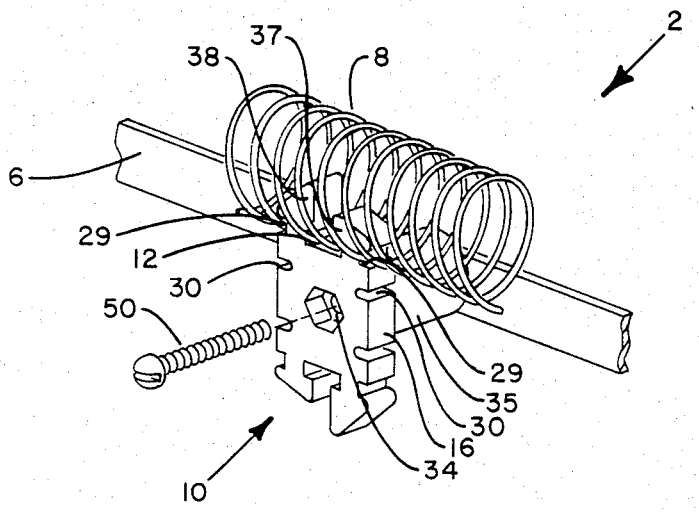
FIG. 5 is a fragmentary, partly exploded, perspective view of an electrical resistance heating assembly with a single electrical insulator according to the present invention having a base portion for directly attaching the insulator to a mounting bar of the assembly.

Referring to FIGS. 4 and 5, still other embodiments are shown of an electrical resistance heating assembly 2 with electrical insulators 10 according to the present invention. The structures shown in FIGS. 4 and 5 are very similar to the structures shown in FIGS. 1 through 3, therefore, like reference numerals have been used to identify like elements. However, in FIGS. 4 and 5 each of the insulators 10 includes a base portion 35, which is an integral part of and which extends generally vertically outward away from the back surface 15 of the slab of electrically insulating material of the electrical insulator 10. The base portion 35 is used to directly attach the insulator 10 to the mounting bar 6 of the electrical resistance heating assembly 2.

As shown in FIGS. 4 and 5, the base portion 35 is cylindrical in shape. However, the base portion 35 may be any of a variety of shapes allowed by the particular manufacturing process used to make the electrical insulator 10. As will be readily apparent to one of ordinary skill in the art to which the present invention pertains, if the electrical insulator is made from certain ceramic material then the shape of the base portion 35 may be limited to certain specific configurations depending on the particular manufacturing method used to form the electrical insulator 10.

As shown in FIG. 4, a pair of electrical insulators 10 may be attached back-to-back to the mounting bar 6 with a screw 31 and nut 32. The screw 31 is inserted through a central opening 34 in the slab of electrically insulating material and through a corresponding opening in the base portion 35 of one of the insulators 10. There is a matching opening (not shown) in the mounting bar 6 through which the screw 31 passes through the mounting bar 6. Then the screw 31 passes through another central opening 34 in the base portion 35 and the slab of electrically insulating material of the other, second insulator 10. The nut 32 is positioned in a hexagonal receptacle which is part of the central opening 34 in the slab of electrically insulating material of the second insulator 10 and the screw 31 is screwed into the nut 32 to hold the pair of insulators 10 on the mounting bar 6. Alternatively, as shown in FIG. 5, a single insulator 10 may be attached to the mounting bar 6 with a sheet metal screw which is inserted through the central opening 34 in the insulator 10 and screwed into a matching opening (not shown) in the mounting bar 6.

In either case described above, the outer end of the base portion 35 is in contact with the mounting bar 6 and this outer end may have "feet" (not shown in FIGS. 4 and 5) for holding the base portion 35 on the mounting bar 6. This prevents rotation of the electrical insulator 10 relative to the mounting bar 6. The "feet" are simply extensions of the outer end of the base portion 35 between which the mounting bar 6 is fitted. That is, there is a slot in the outer end of the base portion 35 into which the mounting bar 6 fits and the extensions of the base portion 35 forming the slot are called the feet. Preferably there are two feet but, if desired, it is possible to use only one "foot" on the outer end of the base portion 35.

The structures shown in FIGS. 4 and 5 eliminate the need for cross bars 5 such as shown in FIGS. 1 and 2. Also the additional mass provided by the base portion 35 structurally strengthens each of the insulators 10 and may make the insulators 10 less susceptible to adverse effects due to thermal stresses caused by temperature cycling. Notches 30 for relieving such thermal stresses are shown in the insulators 10 depicted in FIGS. 4 and 5 but it should be noted that depending on the particular thermal characteristics of a particular insulator 10 these notches 30 may not be needed when using insulators 10 with base portions 35 of the kind shown in FIGS. 4 and 5.

Of course, the foregoing description is directed to particular embodiments of the present invention and various modifications and other embodiments of the present invention will be readily apparent to one of ordinary skill in the art to which the present invention pertains. Therefore, while the present invention has been described in conjunction with these particular embodiments, it is to be understood that various modifications and other embodiments of the present invention may be made without departing from the scope of the invention as described herein and as claimed in the appended claims.

What is claimed is:

1. An electrical resistance heating assembly comprising:

an electrical resistance heating coil;

a mounting bar;

at least one electrical insulator connected to the mounting bar and supporting the electrical resistance heating coil, said electrical insulator comprising a slab of electrically insulating material having generally flat parallel opposed front and back surfaces and having at least one end surface generally perpendicular to the front and back surfaces, a first and second arm mounted on and extending outwardly away from said at least one end surface, said first and second arms are configured relative to each other to form an inverted generally T-shaped opening between the arms for engaging and retaining loops of the electrical resistance heating coil, each of said arms having first substantially vertical inside surfaces forming the leg of the T-shaped opening for engaging and compressing loops of the electrical resistance heating coil during mounting of the coil on the arms of the electrical insulator and second substantially vertical surfaces forming the outer portion of the cross bar of the T-shaped opening for retaining loops of the electrical resistance heating coil;

said first arm having a top part with a generally triangular cross section in a plane parallel to the front and back surfaces of the slab of electrically insulating material, with one leg of the triangular top part defining one of the first substantially vertical inside surfaces which form the leg of the T-shaped opening and with the hypotenuse of the triangular top part defining a cam surface for spreading a coil loop of the electrical resistance heating coil when the coil is mounted on the slab of electrically insulating material;

said second arm spaced from the first arm and also having a top part with a generally triangular cross section in a plane parallel to the front and back surfaces of the slab of electrically insulating material, with one leg of the triangular top part of the second arm defining the other first substantially vertical inside surface which forms the leg of the T-shaped opening and with this leg of the triangular top part of the second arm extending outward away from the end surface of the slab of electrically insulating material a distance, greater than the distance that the opposing leg of the triangular top part of the first arm extends outward away from the end surface, to form a stop surface against which the electrical resistance heating coil may be compressed during mounting of the coil on the first and second arms, and with the hypotenuse of the triangular top part of the second arm forming a cam surface for spreading a coil loop of the electrical resistance heating coil when the coil is mounted on the slab of electrically insulating material; and means for securing the electrical insulator to the mounting bar.

2. An electrical resistance heating assembly as recited in claim 1 wherein the slab of electrically insulating material further comprises:

cuts in the side surface of the slab of electrically insulating material generally in the same plane as the cross bar of the T-shaped opening for engaging the coil loops spread by the cam surfaces of the first and second arms.

3. An electrical resistance heating assembly as recited in claim 2 wherein the slab of electrically insulating material further comprises:

notches in the side surface of the slab of electrically insulating material, below the cuts in the side surfaces, said notches positioned and sized to provide relief from thermal stresses caused by heat conduction away from the electrical resistance heating coil to the slab of electrically insulating material during operation of the electrical resistance heating assembly.

4. An electrical insulator for use in supporting an electrical resistance coil in an electrical resistance heating assembly comprising:

a slab of electrically insulating material having generally flat parallel opposed front and back surfaces and having two end surfaces and two side surfaces generally perpendicular to the front and back surfaces, at least one of said end surfaces having first and second arms mounted thereon and extending outwardly therefrom which are configured relative to each other to form an inverted generally T-shaped opening between the arms for engaging and retaining loops of the electrical resistance heating coil, each of said arms having first substantially vertical inside surfaces forming the leg of the T-shaped opening for engaging and compresing loops of the electrical resistance heating coil during mounting of the coil on the arms of the electrical insulator and second substantially vertical inside surfaces forming the outer vertical portions of the cross bar of the T-shaped opening for retaining loops of the electrical resistance heating coil;

said first arm having a top part with a generally triangular cross section in a plane parallel to the front and back surfaces of the slab of electrically insulating material, with one leg of the triangular top part defining one of the first substantially vertical inside surfaces which form the leg of the T-shaped opening and with the hypotenuse of the triangular top part defining a cam surface for spreading a coil loop of the electrical resistance heating coil when the coil is mounted on the slab of electrically insulating material; and said second arm spaced from the first arm and also having a top part with a generally triangular cross section in a plane parallel to the front and back surfaces of the slab of electrically insulating material, with one leg of the triangular top part of the second arm defining the other first substantially vertical inside surface which forms the leg of the T-shaped opening and with this leg of the triangular top part of the second arm extending outward away from the end surface of the slab of electrically insulating material a distance, greater than the distance that the opposing leg of the triangular top part of the first arm extends outward away from the end surface, to form a stop surface against which the electrical resistance heating coil may be compressed during mounting of the coil on the first and second arms, and with the hypotenuse of the triangular top part of the second arm forming a cam surface for spreading a coil loop of the electrical resistance heating coil when the coil is mounted on the slab of electrically insulating material.

5. An electrical insulator for use in supporting an electrical resistance coil in an electrical resistance heating assembly as recited in claim 4, wherein the slab of electrically insulating material further comprises:

cuts in said side surfaces of the slab of electrically insulating material generally in the same plane as the cross bar of the T-shaped opening for engaging the coil loops spread by the cam surfaces of the first and second arms.

6. An electrical insulator for use in supporting an electrical resistance coil in an electrical resistance heating assembly as recited in claim 5, wherein the slab of electrically insulating material further comprises:

notches in said side surfaces of the slab of electrically insulating material, below the cuts in the side surfaces, said notches positioned and sized to provide relief from thermal stresses caused by heat conduction away from the electrical resistance heating coil to the slab of electrically insulating material during operation of the electrical resistance heating assembly.

* * * * *